United States Patent [19]

Brandl

[11] Patent Number: 4,641,889

[45] Date of Patent: Feb. 10, 1987

[54] CUTTING MACHINE

[75] Inventor: Erich Brandl, Knittelfeld, Austria

[73] Assignee: Voest-Alpine Aktiengesellschaft, Muldenstrasse, Austria

[21] Appl. No.: 773,364

[22] Filed: Sep. 6, 1985

[30] Foreign Application Priority Data

Sep. 20, 1984 [AT] Austria ..... 2997/84

[51] Int. Cl.[4] ..... F21C 27/24

[52] U.S. Cl. ..... 299/75; 299/76

[58] Field of Search ..... 299/75, 76, 73, 78, 299/74; 173/38, 43

[56] References Cited

U.S. PATENT DOCUMENTS 3,929,378 12/1975 Frenyd et al. ..... 299/64
3,966,258 6/1976 Dolecki ..... 299/76
4,349,230 9/1982 Hamburger et al. ..... 299/75 X

FOREIGN PATENT DOCUMENTS 2027192 2/1972 Fed. Rep. of Germany .

*Primary Examiner*—Stephen J. Novosad
*Assistant Examiner*—Michael A. Goodwin
*Attorney, Agent, or Firm*—Cushman, Darby & Cushman

[57] ABSTRACT

In a cutting machine, a cutting arm is swivellable around a horizontal axis and around a vertical axis and carries on its free end a cutting tool. The horizontal swivelling axis of the cutting arm is displaceable relative to the frame of the cutting machine. Displacing of the horizontal swivelling axis is allowed by arranging the swivelling axis on a rocker arm connected with the frame of the cutting machine and is turnable around a vertical axis and is swivellable around a horizontal swivelling axis. With the rocker arm assuming a lowered position, the horizontal swivelling axis of the rocker arm is, as seen in an advancing direction, located in front of the horizontal swivelling axis of the cutting arm. The swivelling drive, for example is formed of a hydraulic piston-cylinder-arrangement, for swivelling the cutting arm around its horizontal swivelling axis and is supported on the rocker arm. The rocker arm can be swivelled around its swivelling axis on the cutting machine from a backwardly directed and approximately horizontal position at least to an upwardly directed and approximately vertical position. The rocker arm is supported on a conventional traversing gear of a cutting machine having a universally swivellable cutting arm.

6 Claims, 2 Drawing Figures

CUTTING MACHINE

BACKGROUND OF THE INVENTION

The invention refers to a cutting machine comprising a cutting arm being swivellable around a horizontal axis and a vertical axis and carrying on its free end the cutting tool, the horizontal swivelling axis of the cutting arm being displaceable relative to the frame of the cutting machine. By displaceably arranging the horizontal swivelling axis, the operating range of the cutting tool is increased. From the DE-OS No. 27 20 380 there has become known a cutting machine in which the turntable of the cutting arm support is shiftably supported on the cutting machine by means of a guiding sliding carriage. From the DE-OS No. 26 56 703 there has become known a cutting machine in which the horizontal swivelling axis is shiftably supported on the cutting machine by means of a guiding sliding carriage, the console of the sliding carriage being supported on the machine frame for being swivellable in the vertical plane and for being turnable around a vertical axis. In both cases there are required expensive guiding sliding carriages which are subject to a heavy wear on account of the dust generation. Furthermore, the operating range of the cutting tool is only insufficiently increased by the guiding sliding carriage.

SUMMARY OF THE INVENTION

The invention aims at increasing the operating range of the cutting tool by using simple constructional features, and the invention is essentially characterized in that the horizontal swivelling axis of the cutting arm is arranged on a rocker arm being connected with the frame of the cutting machine for being turnable around a vertical axis and for being swivellable around a horizontal swivelling axis and in that in lowered position of the rocker arm in its horizontal swivelling axis is, as seen in the advance direction, located in front of the horizontal swivelling axis of the cutting arm, noting that the swivelling drive, for example being formed of a hydraulic piston-cylinder-arrangement, of the cutting arm for swivelling around the horizontal swivelling axis is supported on the rocker arm. By swivelling the rocker arm carrying the swivelling axis of the cutting arm, the operating range of the cutting tool is increased. On account of the rocker arm being pivotally linked to the cutting machine and the cutting arm in its turn being pivotally linked to the rocker arm, an increase of the cutting area is obtained only by means of joints, thus making unnecessary sliding guiding carriages which are subject to heavy wear in the dust-laden atmosphere. On account of the horizontal swivelling axis of the rocker arm being, in the lowered position of the rocker arm, located, as seen in the advance direction, in front of the horizontal swivelling axis of the cutting arm, upward swivelling of the rocker arm takes place in the forward direction. By upwardly swivelling the rocker arm, the operating range of the cutting tool is displaced in the upward direction as well as in the forward direction. This is of particular advantage in connection with a cutting procedure in which first a calotte or overhead vault is advanced by cutting and subsequently the lower area or step is cut. On account of the horizontal cutting axis of the cutting arm being moved in the upward direction and in the forward direction if the rocker arm assumes an upright position, the calotte or dome being located at a higher level can be advanced to a greater depth. In the lowered position of the rocker arm, the rocker arm extends approximately horizontally in the backward direction from its swivelling axis on the cutting machine.

The swivelling axis of the cutting arm on the rocker arm thus assumes a lower and more backward position in which the step can be cut in an advantageous manner. According to the invention the rocker arm is thus preferably swivellable around its swivelling axis on the cutting machine from a backwardly directed and approximately horizontal position at least in an upwardly directed and approximately vertical position. From the upwardly directed position of the rocker arm, the cutting tool can be advanced, for example for the purpose of advancing the calotte, by swivelling the rocker arm in the forward direction.

According to the invention and according to a preferred embodiment, the cutting arm can be driven to effect a movement around its horizontal swivelling axis and the rocker arm can be driven to effect a swivelling movement around its horizontal swivelling axis for advancing the cutting tool in the vertical direction. The cutting tool can thus be guided along the mine face and in the height direction simultaneously by swivelling the cutting arm relative to the rocker arm and by swivelling the rocker arm relative to the cutting machine. By these superimposed swivelling movements it becomes possible to cut the mine face along a straight vertical line.

According to a preferred embodiment of the invention, the cutting arm is swivellable relative to the rocker arm for an angle of more than 90°. In the rearwardly extending position of the rocker arm, the cutting arm can thus be lowered around its swivelling axis to such an extent that it rests on the rocker arm. In this case, the cutting arm and the rocker arm are, so to say, folded together. In this manner it becomes possible that, according to the invention, the cutting arm rests, in lower cutting areas, on the rocker arm and is swivelled around the horizontal swivelling axis of the rocker arm together with the rocker arm. On account of the swivelling axis of the rocker arm being located in a more forward position on the cutting machine than the swivelling axis of the cutting arm on the rocker arm, it becomes possible to downwardly swivel the cutting arm to a low level without the risk of a collision of the cutting arm with a loading ramp optionally provided on the cutting machine. In this manner it becomes possible to make sure the cutting tool also undercuts below the floor on which the cutting machine is movable.

In a simple embodiment of the invention, the rocker arm is conveniently supported on a conventional traversing gear of a cutting machine comprising a universally cutting arm, noting that a lever arm of the rocker arm is connected with the turntable via at least one hydraulic piston-cylinder arrangement.

BRIEF DESCRIPTION OF THE DRAWINGS

In the drawing, the invention is schematically illustrated with reference to an embodiment.

DETAILED DESCRIPTION OF THE PREFERRED EMBODIMENT

Figure 1:
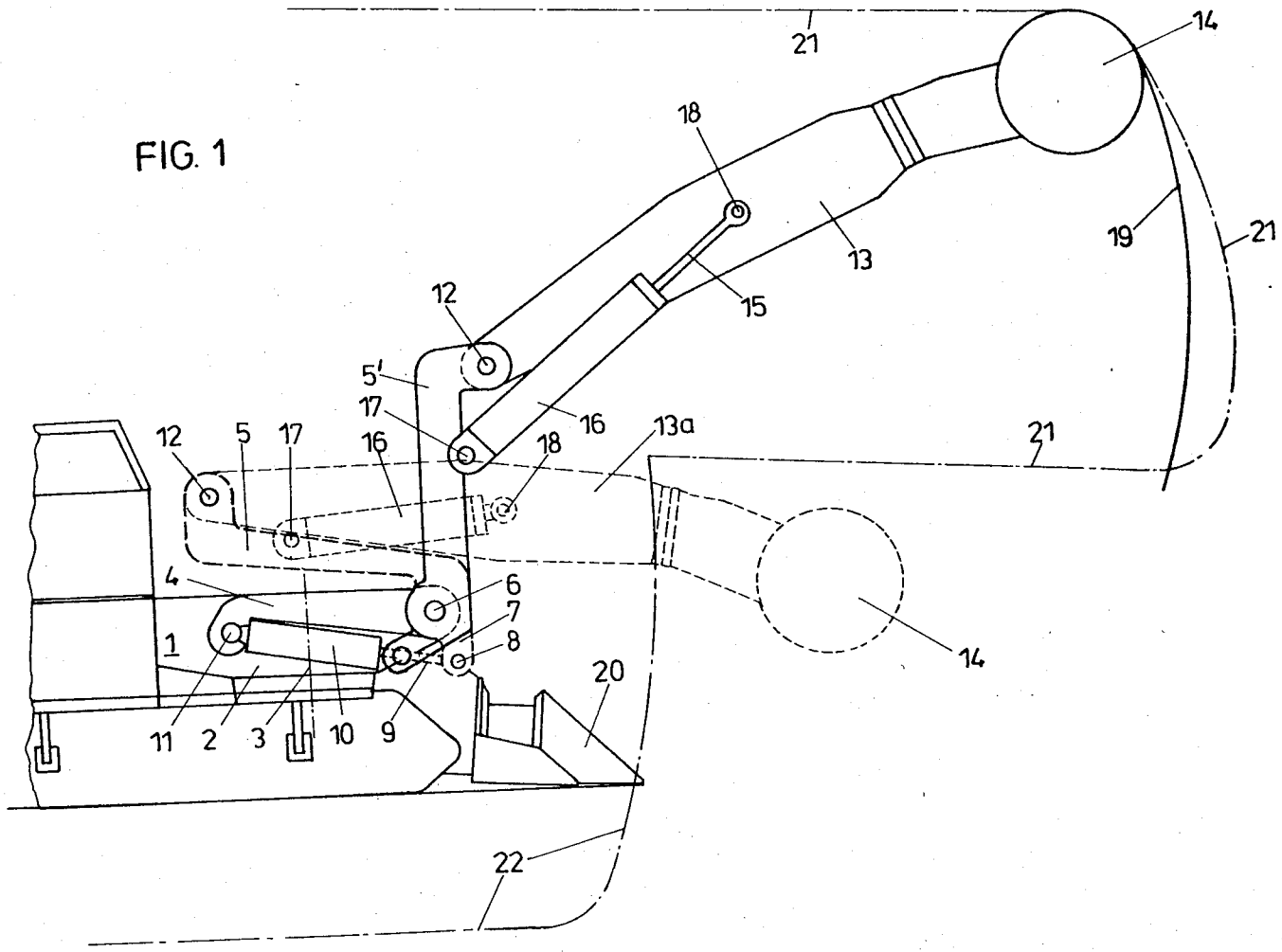
FIG. 1 shows a side elevation of the cutting machine.
Figure 2:
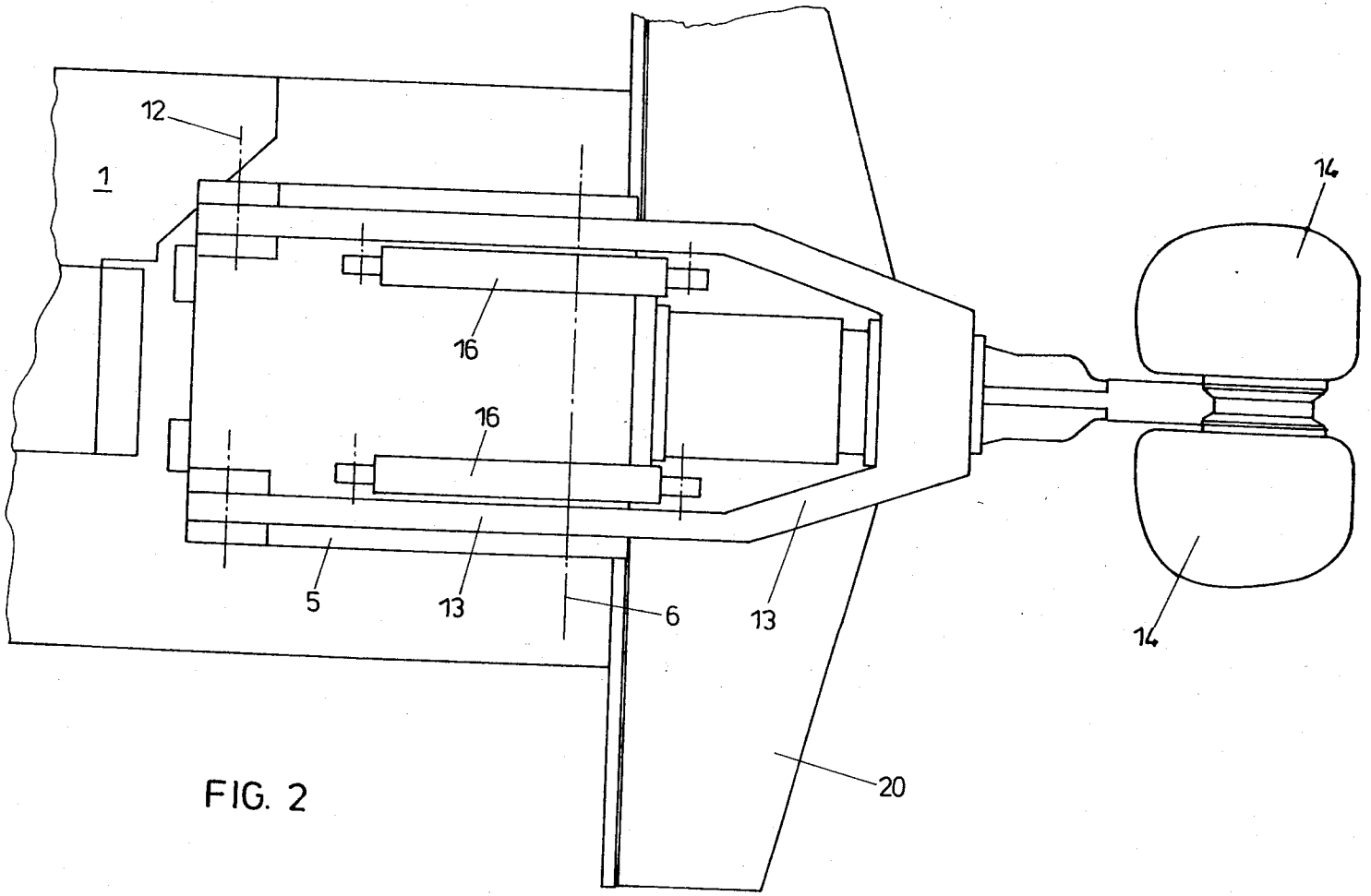
FIG. 2 shows a top plan view.

The cutting machine 1 is equipped with a traversing gear 2 having a vertical axis 3 of rotation. This traversing gear 2 can be a conventional traversing gear, directly carrying the cutting arm 13 of the cutting machine 1. On the turntable 4 of this traversing gear 2, there is pivotally linked a rocker arm 5 for being upward swivellable around a horizontal swivelling axis 6. This rocker arm 5 has a lever arm 7 to which is linked at pivot 8 the piston rod 9 of a hydraulic cylinder 10 in its turn being linked to the turntable 4 at pivot 11. By means of the piston-cylinder-arrangement 9, 10, the rocker arm 3 can be swivelled around the horizontal swivelling axis 6 in the upward direction into the upright position 5' and further beyond this position. The rocker arm 5 can thus be turned together with the turntable 4 around the vertical axis 3. The rocker arm 5 carries a swivelling axis 12 to which is linked the cutting arm 13 carrying at its free end the cutting heads 14. The cutting arm 13 is supported against the rocker arm 5 by means of a piston-cylinder-arrangement 15, 16. The joint links the piston-cylinder-arrangement 15, 16 to the rocker arm 5 and the joint 18 links said arrangement 15, 16 to the cutting arm 13. In the upwardly swivelled position 5' of the rocker arm 5, there can be cut an area of the mine face which is located at a higher level. This area can, for example, be the calotte or dome overhead to be cut first. With the rocker arm 5 resting in the position 5', the mine face is cut along an arc 19. When simultaneously swivelling the cutting arm 13 around the swivelling axis 12 and the rocker arm 5 around the swivelling axis 6, a vertical mine face can be obtained.

If the lower area of the mine face, for example the step remaining after the cutting head 14 has advanced the calotte, shall be cut, the rocker arm 5 is backwardly swivelled. In this case the cutting arm 13 can, as is illustrated by the position 13*a*, be downwardly swivelled to such an extent that it rests on the rocker arm 5. In this case, the cutting arm 13 can exert its swivelling movement around the horizontal swivelling axis 6. On account of this swivelling axis 6 assuming on the cutting machine 1 an extremely forward position, the cutting arm 13 can, for the purpose of making an undercut, be downwardly swivelled to a great extent without risking a collision with the loading ramp 20 of the cutting machine 1.

By the dash-dotted line 21 and the line 19 there is indicated the longitudinal profile of a vault and of a step which can easily be cut with the cutting machine 1. It is also possible to make an undercut having the profile indicated by the dash-dotted line 22.

What is claimed is:

1. A cutting machine comprising:

a frame;

a cutting tool;

a cutting arm being swivellable around a first horizontal swivelling axis and a vertical axis and carrying the cutting tool on a free end, said first horizontal swivelling axis being displaceable relative to the frame;

a rocker arm connected at one end to the frame and connected at an opposite end at the first horizontal swivelling axis of the cutting arm;

said rocker arm being turnable around the vertical axis and being swivellable around a second horizontal swivelling axis through said one end of the rocker arm;

wherein said rocker arm in a lowered position is so arranged that the second horizontal swivelling axis is located relative to the frame in front of the first horizontal swivelling axis;

said rocker arm further being swivellable around the second horizontal swivelling axis from a backwardly directed and approximately horizontal position into an upwardly directed and approximately vertical position; and drive means, supported on the rocker arm, for swivelling the cutting arm around the first horizontal swivelling axis.

2. The cutting machine according to claim 1, wherein the swivelling drive means is a first hydraulic piston-cylinder arrangement.

3. The cutting machine according to claim 2, further comprising:

a turntable supported on the frame and connected at a front end to the one end of the rocker arm;

a second hydraulic piston-cylinder arrangement connected at one end to a rear end of the turntable and connected at an opposite end to the one end of the rocker arm; and a lever arm means, connected at one end to the second horizontal swivelling axis and connected at an opposite end to a piston of the second hydraulic piston-cylinder arrangement, for raising and lowering the rocker arm upon actuation by the second hydraulic piston-cylinder arrangement.

4. The cutting machine according to claim 1, wherein the cutting arm is swivellable relative to the rocker arm through an angle of more than 90°.

5. The cutting machine according to claim 1, wherein for vertically moving the cutting arm, said cutting arm can be driven to effect a swivelling movement around the first horizontal swivelling axis and said rocker arm can be driven to effect a swivelling movement around the second horizontal swivelling axis.

6. The cutting machine according to claim 1, wherein, for cutting an area lower than the frame, said cutting arm is partially reclined on the rocker arm and swivels around the second horizontal swivelling axis together with the rocker arm.

* * * * *